United States Patent [19]

Leifeld et al.

[11] Patent Number: 4,535,511

[45] Date of Patent: Aug. 20, 1985

[54] METHOD AND APPARATUS FOR CONTROLLING AND REGULATING MACHINES OF A TEXTILE FIBER PROCESSING LINE

[75] Inventors: Ferdinand Leifeld, Kempen; Fritz Hösel, Monchen-Gladbach, both of Fed. Rep. of Germany

[73] Assignee: Trützschler GmbH & Co. KG, Monchen-Gladbach, Fed. Rep. of Germany

[21] Appl. No.: 481,398

[22] Filed: Apr. 1, 1983

[30] Foreign Application Priority Data

Apr. 1, 1982 [DE] Fed. Rep. of Germany ..... 3212148
Dec. 2, 1982 [DE] Fed. Rep. of Germany ..... 3244619

[51] Int. Cl.[3] ..... D01H 5/38

[52] U.S. Cl. ..... 19/105; 19/240; 19/300

[58] Field of Search ..... 19/105, 240, 300, 80 R, 19/200

[56] References Cited

U.S. PATENT DOCUMENTS 4,161,052 7/1979 Erben ..... 19/240
4,321,732 3/1982 Erben ..... 19/240
4,353,148 10/1982 Beneke ..... 19/105

FOREIGN PATENT DOCUMENTS 879699 10/1961 United Kingdom .
973662 10/1964 United Kingdom .
1007772 10/1965 United Kingdom .
1312834 4/1973 United Kingdom .
1353378 5/1974 United Kingdom .
1478903 7/1977 United Kingdom .
1497925 1/1978 United Kingdom .
1517229 7/1978 United Kingdom .
1594432 7/1981 United Kingdom .

*Primary Examiner*—Louis K. Rimrodt
*Attorney, Agent, or Firm*—Spencer & Frank

[57] ABSTRACT

A method of regulating fiber quantities supplied to a fiber processing machine of a fiber processing line. The latter includes a fiber storing apparatus connected downstream of the fiber processing machine and receives processed fiber therefrom. The fiber processing machine includes a feed roller supplying fiber thereto. The method comprises the following steps: continuously rotating the feed roller by a regulatable drive during operation of the fiber processing line; generating a measuring value representing momentary fiber quantities in the storing apparatus; generating an analog electric signal representing the measuring value; and applying the analog electric signal to the regulatable drive of the feed roller for varying the rpm thereof as a function of the fiber quantity in the storing apparatus.

8 Claims, 7 Drawing Figures

METHOD AND APPARATUS FOR CONTROLLING AND REGULATING MACHINES OF A TEXTILE FIBER PROCESSING LINE

BACKGROUND OF THE INVENTION

This invention relates to a method and an apparatus for controlling and regulating machines of a textile fiber processing line which prepares textile fiber for spinning. The control and regulation affects, for example, the fiber quantity to be supplied to an opener and/or a textile fiber cleaner. For example, a measuring value representing the fiber quantity is taken from a feed chute connected to and downstream of a fiber processing machine, as viewed in the direction of material advance; then the measuring value is converted to an electric signal applied to a setting member which varies the fiber quantity to be supplied to the downstream-connected machine as a function of the signal.

In practice, an opener and cleaner arranged in line have heretofore been controlled such that the material feeding roller is rotated in a "stop-and-go" operation dependent upon the demand of the fiber processing machine. The downstream-located machines are, as a rule, storage devices (feed chutes) or contain such devices. The height level of the material in the feed chute is conventionally detected by sensors with a "yes-no" function such as photocells or electronic pressure responsive switches to sense the counterpressure which is a measure for the height level of the material. The sensors, corresponding to a yes-or-no determination, cause an energization or de-energization of the material feed drive.

The above-outlined conventional method has the disadvantage that during the pause periods no opening or cleaning work takes place while during the operative periods an increased amount of work has to be performed relative to the average flow rate of material. Since the cleaning and opening quality improves as the material flow rate decreases, the quality deteriorates as the idle periods increase. In case of an idle-to-operation period ratio of, for example, 50:50, during the work phase twice the average quantity has to be processed.

SUMMARY OF THE INVENTION

It is an object of the invention to provide an improved method and apparatus of the above-outlined type from which the noted disadvantages are eliminated and with which improved textile cleaning and opening results may be achieved.

These objects and others to become apparent as the specification progresses, are accomplished by the invention, according to which, briefly stated, an electric analog signal is generated from the measuring magnitude representing the fiber quantities and is applied to a regulatable setting member for the continuous operation of at least one feed roller of the fiber processing machine such as an opener and/or a cleaner.

It is an important aspect of the invention to maintain the material feed drive in operation during work periods of the opener and the cleaner. For this purpose, the level (quantity) of the material in the downstream-located apparatus is sensed in an analog manner and, dependent from the signal generated as a function of the sensed magnitude, the material advancing mechanism is driven slower or faster. Such an operation may be effected automatically by a regulator. The actual value is formed by the height level of the fiber tuft column in the downstream-located feed chute or the pressure in the downstream-located system. The setting member constitutes an rpm setter for the material feeding device serving the opener or the cleaner. This regulation may be exclusively analog and stepless or may operate in steps. The short-period, batch-like (intermittent) rate of, for example, 500 kg/hour of fiber material experienced in the conventional process (stop-and-go drive) is, when the method according to the invention is practiced, reduced to a continuous rate of 250 kg/hour in case of a 50:50 ratio. In this manner, the cleaning effect is significantly improved. In order to achieve a uniform opening quality—as viewed over time—the fiber tuft weight per opening tooth or opening pin in the opening roller should remain constant. For this purpose, according to a further feature of the invention, the regulating signal varies the rpm's of the drives for the feed roller and for at least one opening roller in proportion to one another. Thus, the faster the material feed drive delivers, the faster should the opening roller rotate. This result can be economically achieved by means of a common drive. The rpm-controllable drive motor drives the opening roller by means of a reduction gear. By means of a gearing, the motor rpm, or opener rpm or an intermediate rpm is lowered to a very low feed roller rpm.

In the apparatus according to the invention, signals from the measuring member for the fiber quantity are applied to a regulator which, in turn, is connected with the regulatable drive (motor regulation, drive motor) of at least one material feed roller. According to a particularly advantageous feature of the invention, the regulator is connected with the regulatable drive of at least one opening roller.

DESCRIPTION OF THE PREFERRED EMBODIMENTS

Figure 1:
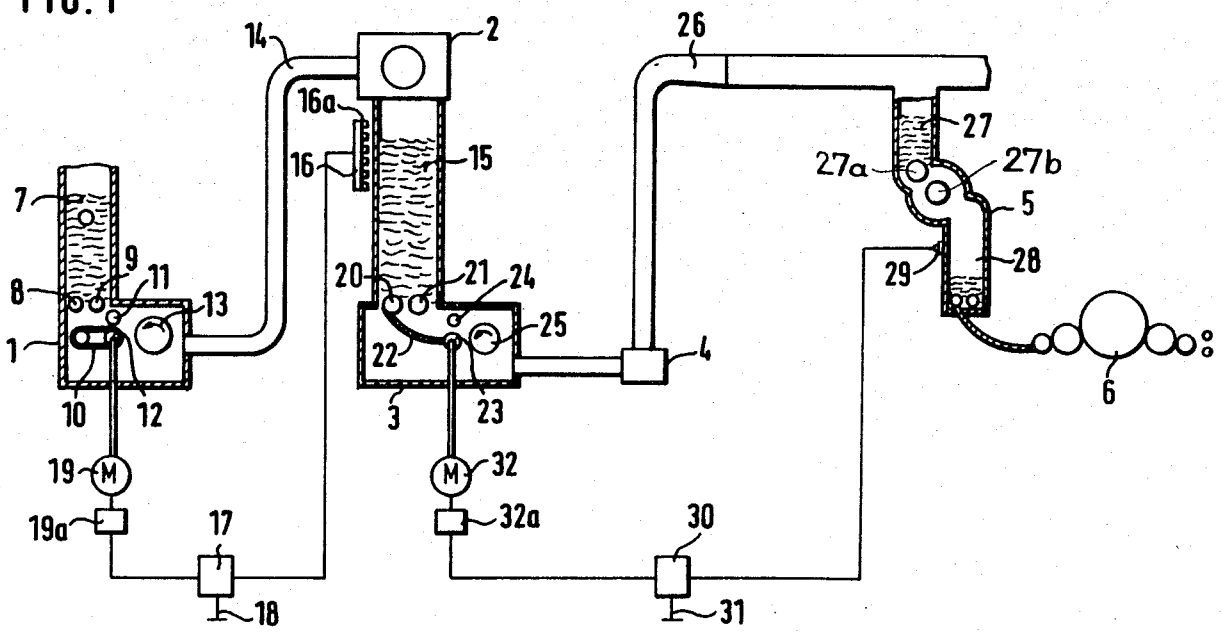
FIG. 1 is a schematic side elevational view, with block diagram, of a fiber cleaning and fiber opening line incorporating a preferred embodiment of the invention.

Turning now to FIG. 1, there is illustrated a known cleaning and opening line formed, for example, of a cleaner 1, a condenser 2, a fine opener 3, a fiber transport fan 4, a pneumatic fiber tuft feed chute 5 and a carding machine 6. The cleaner 1 is supplied with fiber material by a feed chute 7 from which the material is drawn by two delivery rollers 8 and 9 and is advanced to a feeding device which is formed of a conveyor belt 10 and two feed rollers 11 and 12. The latter advance the fiber material to an opening roller 13 from which the material is further advanced in a duct 14 to the screen drum of the condenser 2 and therefrom to the feed chute 15 of a fine opener 3. With the feed chute 15 there is associated a measuring device 16 which comprises several photocells 16*a* and which senses the height of the fiber tuft column in the feed chute 15. The measuring device 16 is connected with a regulator 17 including a desired value setter 18. The regulator 17 is connected with a motor regulator 19*a* of a drive motor 19 which rotates at least one of the feed rollers 11 and 12. An analog electric signal is generated from the measuring value of the fiber quantity in the downstream-located feed chute 15 and applied to the motor regulator 19*a* for continuously operating the drive motor 19 of at least one of the feed rollers 11 or 12 of the cleaner 1.

From the feed chute 15 the fiber material is advanced by two delivery rollers 20 and 21 and a guide element 22 to two feed rollers 23 and 24 which, in turn, forward the fiber material to the opening roller 25 of the fine opener 3. From the fine opener 3 the fiber material is driven by means of the transport fan 4 through a pneumatic conveying duct 26 into an upper reserve chute 27 of a tuft feeding apparatus 5. From the upper reserve chute 27 the fiber material is advanced by a feed roller 27*a* to an opening roller 27*b* and therefrom the material is received in a lower feed chute 28 of a fiber tuft feeding apparatus 5. On one wall of the feed chute 28 there is mounted an electronic pressure responsive switch 29 which transmits analog signals to a regulator 30, having a desired value setter 31. The regulator 30, in turn, is connected to a motor regulator 32*a* of a drive motor 32 which rotates at least one of the feed rollers 23 or 24.

Figure 2:
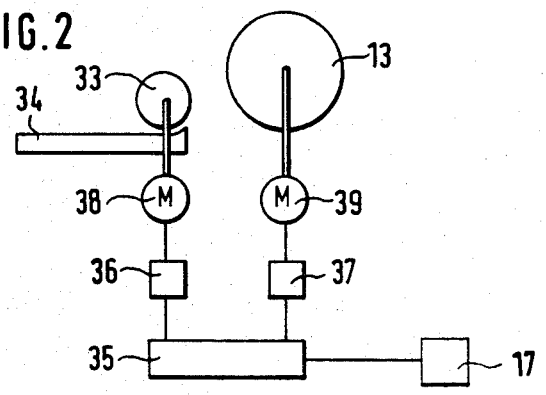
FIGS. 2, 3 and 4 are schematic side elevational views of three different preferred embodiments of one part of the invention.

Turning now to FIG. 2, there is shown a fiber feeding device including a feed roller 33 and a feed table 34 for advancing the fiber material to the opening roller 13 (beater). From the regulator 17 an analog electric signal is applied to a tandem potentiometer 35 which, in turn, is connected to two motor regulators 36 and 37 such as Model SIMOREG regulators manufactured by Siemens AG, Munich, Federal Republic of Germany. The motor regulators 36 and 37 are connected to respective drive motors 38 and 39 which rotate the feed roller 33 and the opening roller 13, respectively.

Figure 3:
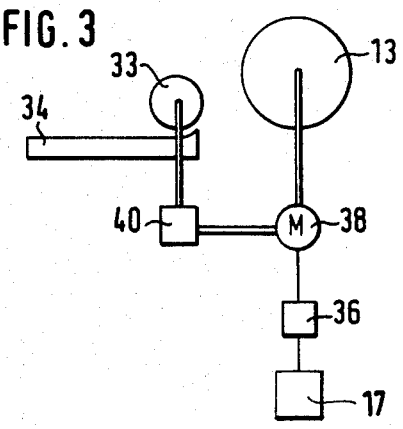

Turning now to FIG. 3, the motor regulator 36 is connected to a drive motor 38 which is directly rotating the opening roller 13 and is also rotating the feed roller 33 with the intermediary of a reduction gear 40.

Figure 4:
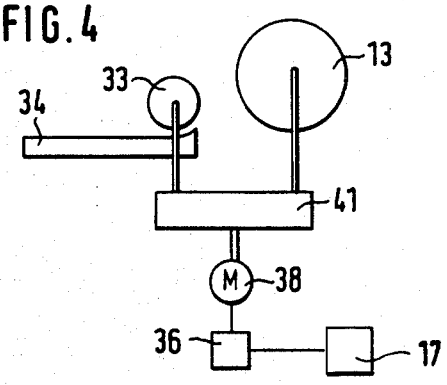

Turning now to FIG. 4, in the embodiment shown therein, the motor 38 is connected to a reduction gear 41 which, with different gear ratios, is connected to the opening roller 13 and to the feed roller 33.

The control affects not only the fiber storing devices, openers and cleaners but every machine or machine group forming part of the fiber processing line which prepares the fiber for a subsequent spinning operation.

Figure 5:
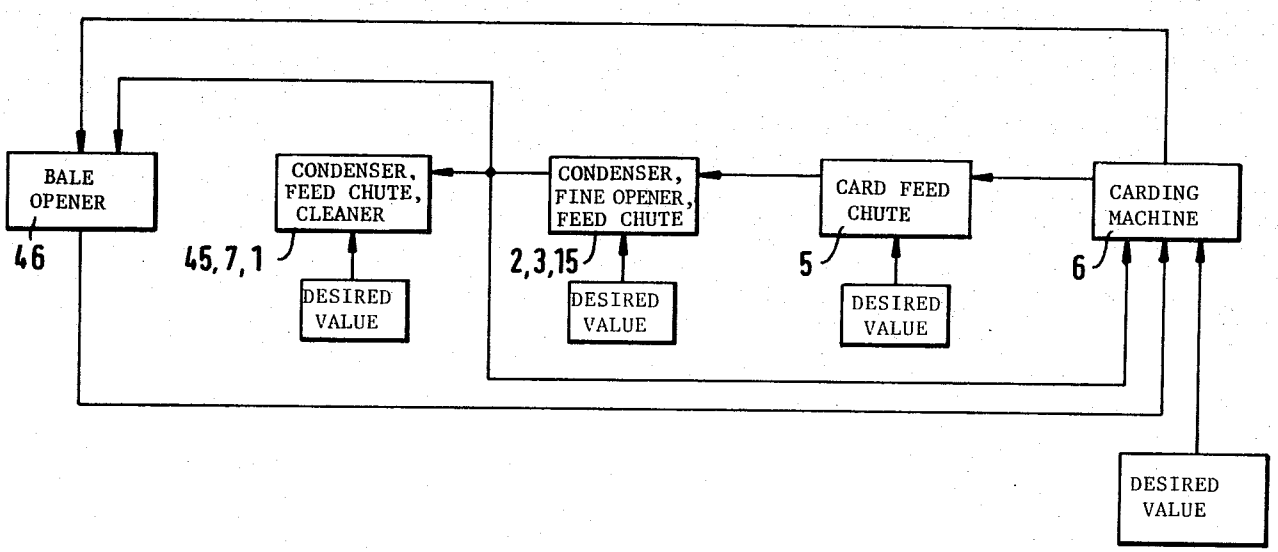
FIG. 5 is a block diagram illustrating the electric interconnection of a control and regulator system of a fiber processing line preparing material for spinning.
Figure 6:
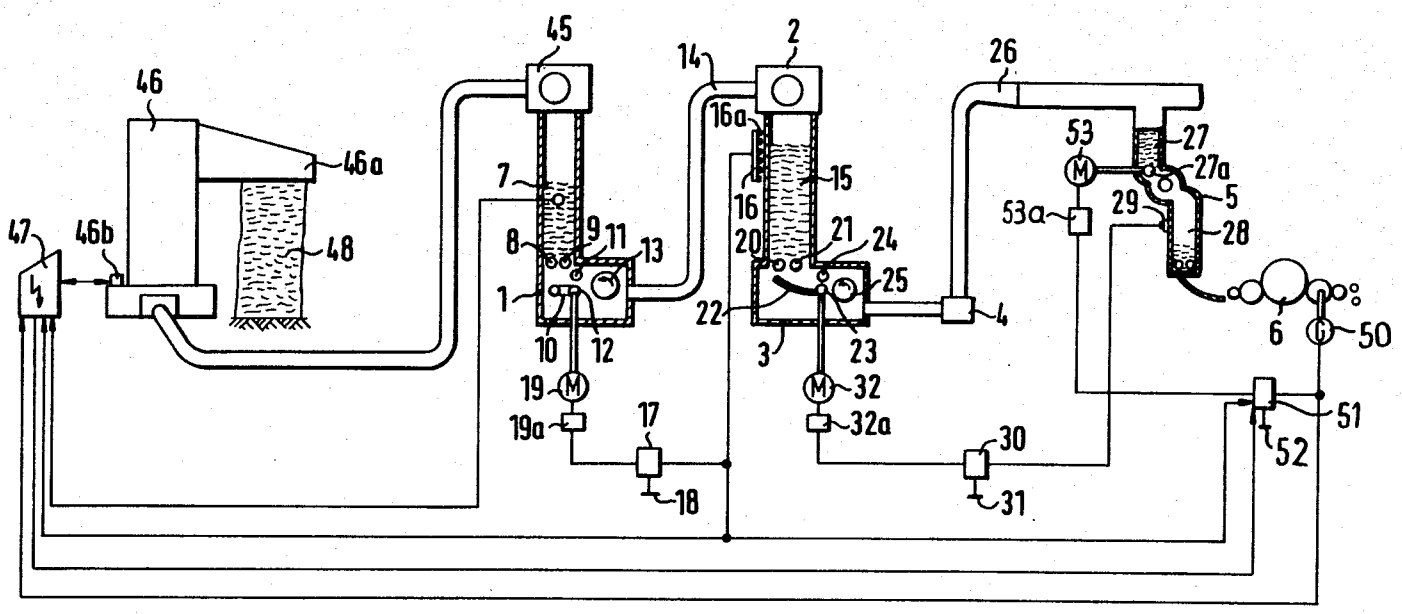
FIG. 6 is a schematic side elevational view, with block diagram, illustrating the electric interconnection of an opening and cleaning line associated with a carding machine.

Turning now to FIGS. 5 and 6, there is shown a cleaning line formed of a plurality of serially connected machines or machine groups such as a bale opener 46, a group formed of a condenser 45, a supply chute 7 and a cleaner 1, a group formed of a condenser 2, a feed chute 15 and a fine opener 3, joined by a feed chute 5 and a carding machine 6, supplied by the feed chute 5. The electric interconnection between the machines or machine groups is shown schematically. For example, in the machine group formed of components 2, 15 and 3, with the feed chute 15 there is associated a measuring device 16 and with the fine opener 3 there is associated a setting member (drive motor) 32. Further, as indicated in FIG. 6, the regulating devices are associated with separate desired value setters.

Turning once again to FIG. 6, the carding machine 6 has, at its web delivery drive (card output), a generator 50 whose voltage represents the web delivery rpm, that is, the production rate of the card. The voltage appearing at the output of the generator 50 is applied to a regulator 51 including a desired value setter 52. The regulator 51 is connected with a motor regulator 53*a* which, in turn, is connected with the drive motor 53 of the feed roller 27*a* of the fiber tuft feed chute 5. In this manner, it is feasible to influence the operation of the feed rollers 27*a* (basic setting) as a function of the production rate predetermined for the carding machine 6. Further, the production rate of the carding machine 6 may be used as a measure for the material quantities to be taken by the bale opener 46. For this purpose, the signal from the generator 50, representing the production rate of the carding machine 6, is applied to a control 47 of the bale opener 46 and is evaluated there. Further, with the aid of the measuring device 16 it is feasible to correct the basic setting (obtained from the carding machine 6), for the material removal by the bale opener 46, as a function of the column height in the feed chute 15. It is further feasible to correct the desired value for the production rate at the carding machine 6, obtained from the control 47 of the bale opener 46. Such an arrangement is considered in particular when in the control 47 it is determined that the opener component 46*a* working on the fiber bales 48 is continuously overloaded because of excessive requirements. The control device 47 is electrically connected with the drive motor 46*b* (travel drive) of the bale opener 46. Further, the control device 47 is electrically connected with a drive motor (not shown) for the height adjustment of the opener component 46*a*.

It is further feasible to provide the regulating devices 17, 30 and 51 with desired values predetermined by a guide computer.

If the measuring device 16 determines that in the feed chute 15, despite requirements placed on the upstream-located machines such as, for example, the cleaner 1 or the bale opener 46, consistently insufficient quantity of material is available, this state is reported to the carding machine 6 and accordingly, a decreased output rate therefor can be set.

Figure 7:
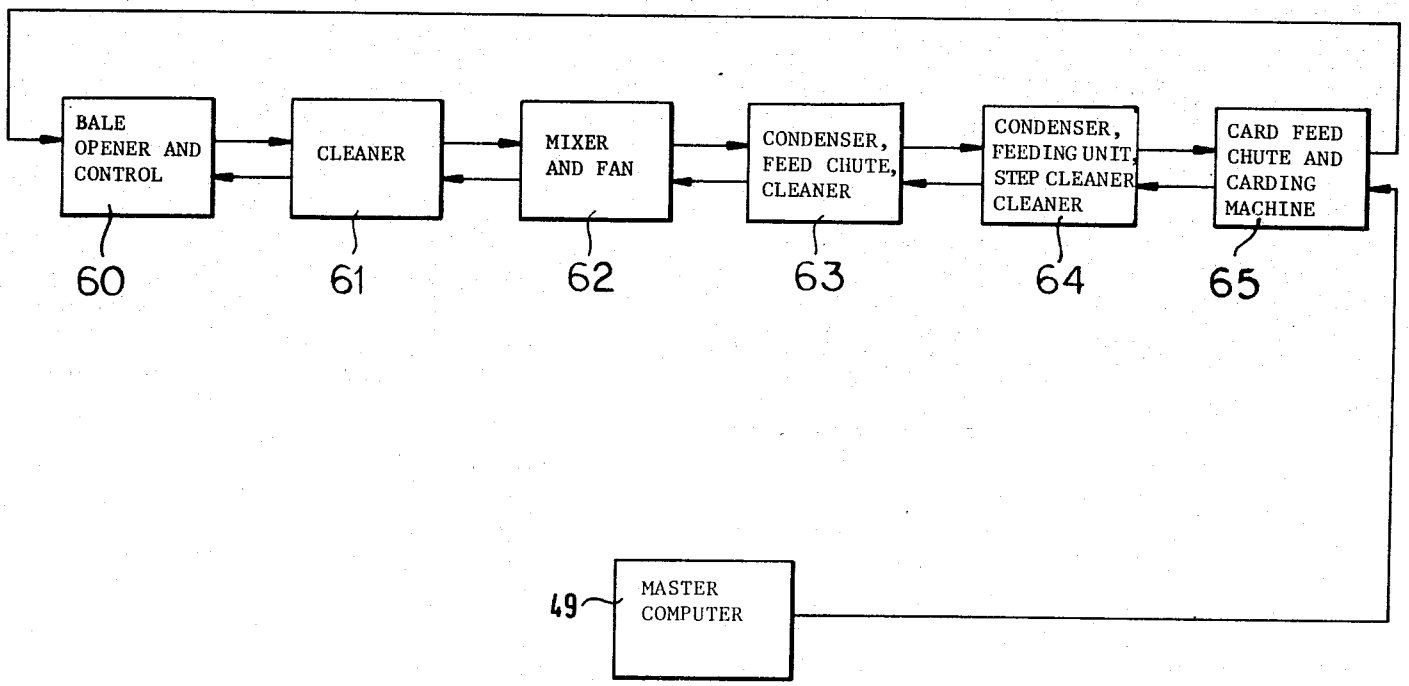
FIG. 7 is a block diagram illustrating the electric interconnection of a fiber processing line with a guiding computer.

Turning now to FIG. 7, blocks 60 through 65 symbolize the individual machines or machine groups which together form a fiber processing (opening, cleaning and carding) line preparing the fiber for a spinning operation. Block 60 represents a bale opener with control, such as earlier-described components 46 and 47, block 61 represents a cleaner, block 62 represents a fiber mixer and a transport fan, block 63 symbolizes a condenser, a feed chute and a cleaner, block 64 represents a condenser, a feeding unit, a step cleaner and a cleaner and box 65 represents a card feed chute and a carding machine. FIG. 7 schematically illustrates the mutual interaction between individual machine controls and machine group controls. These may cooperate to achieve a continuous material flow without central control or, on the contrary, may be influenced by a master computer (guide computer) 49. When such a master control is used, the entire line may be programmed at a service panel for the particular intended purpose. If, for example, one machine line operates alternatingly with different fiber lots (for example, cotton or synthetic wool), the guide computer 49 can determine how the material should be routed, that is, certain cleaning stations or the like may be bypassed or automatically added dependent upon the lot specific data, particularly on fiber characteristics relating to the machine processing. Such data are determined once, then stored and recalled at will. Further, the number of carding machines can be preselected to thus control the production rate. It is also feasible to have the guide computer 49 make suggestions to the operating personnel concerning optimal processing conditions, based on predetermined data. The guide computer 49 may be, for example, a model 8032 computer manufactured by the firm Commodore, 6078 Neu-Isenburg, Federal Republic of Germany.

The various textile machines noted in the foregoing description as forming part of the fiber processing line may be, for example, the following models marketed by Trützschler GmbH & Co. KG, Mönchengladbach, Federal Republic of Germany:

| Machine noted in the Description | Trutzschler Model |
|---|---|
| Cleaner 1 | RV or RK or RS or RN |
| Feed chute 7 or 15 | BS |
| Condenser 2 or 45 | LVS |
| Fine opener 3 | FO |
| Electronic pressure switch 29 | EDS |
| Bale opener 46 | BLENDOMAT BDT |
| Card feed chute 5 | EXACTAFEED FBK |
| Transport fan 4 | MTV |
| Carding machine 6 | DK |
| Cleaner (forming part of the FIG. 7 line) | AXI-FLO AFA |
| Feeding unit (forming part of the FIG. 7 line) | BE |
| Fiber mixer (forming part of the FIG. 7 line) | MPM |
| Step cleaner (forming part of the FIG. 7 line) | SRS |

It will be understood that the above description of the present invention is susceptible to various modifications, changes and adaptations, and the same are intended to be comprehended within the meaning and range of equivalents of the appended claims.

What is claimed is:

1. A method of regulating fiber quantities supplied to a fiber processing machine of a fiber processing line including a fiber storing apparatus connected downstream of said fiber processing machine and receiving processed fiber therefrom, said fiber processing machine including a feed roller supplying fiber thereto and an opening roller; comprising the following steps:

(a) continuously rotating said feed roller and said opening roller by respective regulatable drive means during operation of the fiber processing line;

(b) generating a measuring value representing momentary fiber quantities in said storing apparatus;

(c) generating an analog electric signal representing said measuring value; and (d) applying said analog electric signal to said respective regulatable drive means of said feed roller and said opening roller for varying the rpm of said feed roller and said opening roller in proportion to one another as a function of the fiber quantity in said storing apparatus.

2. In a regulating apparatus for regulating fiber quantities supplied to a fiber processing machine of a fiber processing line including a fiber storing apparatus connected downstream of said fiber processing machine and receiving processed fiber therefrom; said fiber processing machine including a feed roller supplying fiber to said fiber processing machine, an opening roller and a regulatable drive means for rotating said feed roller and said opening roller; the improvement comprising (a) a sensor connected to said fiber storing apparatus for generating a sensor signal representing the fiber quantity in said fiber storing apparatus;

(b) regulator means connected to said sensor for receiving said sensor signal from said sensor and connected to said regulatable drive means for applying thereto an analog control signal for varying the rpm of said feed roller and said opening roller as a function of the fiber quantities in said fiber storing apparatus; and (c) proportioning means operatively interconnecting said feed roller and said opening roller for proportionately varying the rpm of the feed roller and the opening roller relative to one another.

3. A regulating apparatus as defined in claim 2, wherein said proportioning means comprises a potentiometer having an input connected to said regulator means for receiving said analog control signal from said regulator means; said potentiometer having first and second outputs; said regulatable drive means comprising a first drive motor rotating said feed roller and connected to said first output and a second drive motor rotating said opening roller and connected to said second output.

4. A regulating apparatus as defined in claim 2, wherein said regulatable drive means comprises a drive motor connected to said regulator means for receiving said analog control signal from said regulator means; said proportioning means comprises a reduction gear; said drive motor being connected to one of said rollers directly and to the other of said rollers by means of said reduction gear.

5. A regulating apparatus as defined in claim 2, wherein said regulatable drive means comprises a drive motor connected to said regulator means for receiving said analog control signal from said regulator means; said proportioning means comprises a reduction gear having an input connected to said drive motor, a first output connected to said feed roller and a second output connected to said opening roller; said first and second outputs having different gear ratios.

6. In a fiber processing line including a series of fiber processing machines each having fiber feeding means, an input and an output; the output of each fiber processing machine being connected to the input of a downstream adjoining fiber processing machine, as viewed in the direction of fiber travel; a fiber supplying apparatus having an output connected to the input of the first fiber processing machine in the series; the improvement wherein each said fiber processing machine includes means for responding, at least indirectly, to fiber quantities momentarily present in the respective fiber processing machines upstream of the fiber feeding means thereof and for emitting an analog signal representing the fiber quantities; further comprising means for applying the analog signal from each fiber processing machine to the fiber feeding means of an upstream adjoining fiber processing machine for controlling the operation of each fiber processing machine as a function of fiber quantities of a downstream adjoining fiber processing machine; output sensor means connected to the output of the last fiber processing machine in the series for generating a signal representing a fiber output of said last fiber processing machine; and a control means connected to said output sensor means, to each said means responding to fiber quantities and to said fiber supplying apparatus for an interrelated overall control of the fiber processing line.

7. A fiber processing line as defined in claim 6, wherein said fiber supplying apparatus is a bale opener, said first fiber processing machine is a cleaner and said last fiber processing machine is a card.

8. A fiber processing line as defined in claim 7, wherein a fiber processing machine in the series between said first and last fiber processing machines is a mixer.

* * * * *